US008737656B2

(12) United States Patent
Pape et al.

(10) Patent No.: US 8,737,656 B2
(45) Date of Patent: May 27, 2014

(54) HEARING DEVICE WITH FEEDBACK-REDUCTION FILTERS OPERATED IN PARALLEL, AND METHOD

(75) Inventors: Sebastian Pape, Erlangen (DE); Stefan Petrausch, Erlangen (DE); Tobias Wurzbacher, Fuerth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 553 days.

(21) Appl. No.: 13/036,404

(22) Filed: Feb. 28, 2011

(65) Prior Publication Data

US 2011/0211715 A1 Sep. 1, 2011

(30) Foreign Application Priority Data

Feb. 26, 2010 (DE) ..... 10 2010 009 459

(51) Int. Cl.
*H04R 25/00* (2006.01)

(52) U.S. Cl.
USPC ..... 381/318; 381/317

(58) Field of Classification Search
USPC ..... 381/312, 317, 318, 71.11, 71.12, 83, 93
See application file for complete search history.

(56) References Cited

U.S. PATENT DOCUMENTS

| | | | | |
|---|---|---|---|---|
| 6,611,600 | B1 | 8/2003 | Leber et al. | |
| 7,020,297 | B2 | 3/2006 | Fang et al. | |
| 2008/0212816 | A1 * | 9/2008 | Pedersen et al. | 381/318 |
| 2009/0067651 | A1 * | 3/2009 | Klinkby et al. | 381/313 |

FOREIGN PATENT DOCUMENTS

| | | | |
|---|---|---|---|
| DE | 60004539 | T2 | 9/2004 |
| EP | 0930801 | B1 | 11/2008 |

* cited by examiner

*Primary Examiner* — Brian Ensey
(74) *Attorney, Agent, or Firm* — Laurence A. Greenberg; Werner H. Stemer; Ralph E. Locher

(57) ABSTRACT

A hearing device has a signal-processing apparatus for processing an input signal into an output signal, and a feedback-canceller apparatus for reducing feedback artifacts on the basis of the input signal and the output signal. The feedback-canceller apparatus has an adaptive, first filter, for establishing a set of filter coefficients for a predefined feedback situation. The feedback-canceller apparatus is configured to store the set of filter coefficients. It has at least one second filter, which can be operated directly parallel to the first filter on the basis of the stored set of filter coefficients. The adaptive, first filter can be continuously adapted to a current feedback situation, and the feedback-canceller apparatus is configured such that in the current feedback situation it automatically selects either the first or the second filter. As a result, it generally only requires a simple switchover, but not a complete adaptation.

9 Claims, 3 Drawing Sheets

HEARING DEVICE WITH FEEDBACK-REDUCTION FILTERS OPERATED IN PARALLEL, AND METHOD

CROSS-REFERENCE TO RELATED APPLICATION

This application claims the priority, under 35 U.S.C. §119, of German application DE 10 2010 009 459.5, filed Feb. 26, 2010; the prior application is herewith incorporated by reference in its entirety.

BACKGROUND OF THE INVENTION

Field of the Invention

The present invention relates to a hearing device with a signal-processing apparatus for processing an input signal into an output signal, and a feedback-canceller apparatus for compensating for feedback on the basis of the input signal and the output signal. Moreover, the present invention relates to a corresponding method for compensating for feedback in a hearing device. Here, the term hearing device is understood to mean any sound-emitting instrument worn on or in the ear, more particularly a hearing aid, a headset, headphones or the like.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction receiver. The amplifier is usually integrated into a signal-processing unit. This basic configuration is illustrated in FIG. 1 using the example of a behind-the-ear hearing aid. One or more microphones 2 for recording the sound from the surroundings are installed in a hearing-aid housing 1 to be worn behind the ear. A signal-processing unit 3, likewise integrated into the hearing-aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer using a sound tube, which is fixed in the auditory canal with an ear mold. A battery 5, likewise integrated into the hearing-aid housing 1, supplies the hearing aid and, in particular, the signal-processing unit 3 with energy.

During operation, hearing aids are generally afflicted by stronger or not so strong feedback. Feedback is generated both over acoustic paths and over electromagnetic paths. By way of example, acoustic feedback occurs if sound from a hearing-aid loudspeaker is fed back to the microphone of the hearing aid. Electromagnetic feedback can for example occur as a result of inductive coupling between the loudspeaker and another signal-processing component.

The hearing-aid wearer generally cannot perceive the feedback. However, if the amplification in the hearing aid is set to be sufficiently high, feedback can by all means be perceived to be bothersome. If the sound amplified by the hearing aid, as mentioned, finds a path back to the microphones of the hearing aid and is amplified once again, this can lead to shrill-sounding artifacts and/or echoing artifacts.

Modern hearing systems are able to estimate possible feedback paths and to produce corresponding filters for reducing or suppressing the feedback signals. These result in the so-called feedback-canceller apparatuses. Inexpediently, estimating the feedback path, i.e. adapting the respective filter within the hearing aid, requires some time, during which there is a typical feedback whistle or there are other artifacts, for example as a result of adaptation errors.

A filter is adapted step-by-step. A so-called step-size control is usually used for setting the adaptation speed of the feedback-canceller apparatus. If feedback is detected, the step size is increased for a certain amount of time and then is reduced again in order to avoid a disturbance of the useful signal by the feedback-canceller apparatus. However, in any case there must be a feedback whistle or another measurable artifact before a targeted countermeasure can be taken.

German Utility Model DE 600 04 539 T2 discloses a hearing aid with a method for suppressing feedback. The hearing aid has two adaptive filters. European patent EP 0 930 801 B1 corresponding to U.S. Pat. No. 6,611,600, discloses a hearing aid with a two-filter-comprising circuit for suppressing feedback.

SUMMARY OF THE INVENTION

It is accordingly an object of the invention to provide a hearing device with feedback-reduction filters operated in parallel, and a method which overcome the above-mentioned disadvantages of the prior art methods and devices of this general type, which reduces or compensates feedback in hearing devices as effectively and as quickly as possible.

According to the invention, the object is achieved by a hearing device with a signal-processing apparatus for processing an input signal into an output signal, and a feedback-canceller apparatus for compensating for feedback artifacts on the basis of the input signal and the output signal. The feedback-canceller apparatus has an adaptive, first filter, which can be used to establish a set of filter coefficients for a predefined feedback situation. The feedback-canceller apparatus is configured to store the set of filter coefficients. The feedback-canceller apparatus has at least one second filter, which can be operated directly parallel to the first filter on the basis of the stored set of filter coefficients. The adaptive, first filter can be continuously adapted to a current feedback situation, and the feedback-canceller apparatus is configured such that in the current feedback situation it automatically selects either the first or the second filter.

Moreover, according to the invention, provision is made for a method for compensating for feedback in a hearing device. The method includes the steps of processing an input signal to an output signal and reducing feedback artifacts on the basis of the input signal and the output signal. Provision is made for an adaptive, first filter, by which a set of filter coefficients is established for a predefined feedback situation, and the set of filter coefficients is stored in the hearing device. Provision is made for at least one second filter, which is operated directly parallel to the first filter on the basis of the stored set of filter coefficients. The adaptive, first filter is continuously adapted to a current feedback situation, and either the first or the second filter for reducing the feedback artifacts is automatically selected in the current feedback situation.

Advantageously, the plurality of filters operated in parallel allows the selection of the most effective one in the respective situation for the purposes of signal processing. The selection can be brought about more quickly than a complex adaptation process.

It is preferable for the first filter to be an FIR filter and the second filter to be an IIR filter. The coefficients obtained from an adaptive FIR filter must then be converted for an IIR filter. An IIR filter in general requires substantially less calculation time than a corresponding FIR filter.

In an alternative embodiment, all filters that are part of the feedback-canceller apparatus and can be operated in parallel can be FIR filters. This is advantageous in that the coefficients of an adaptive FIR filter can easily be transferred to a parallel FIR filter.

Moreover, it can be expedient for the set of filter coefficients in the feedback-canceller apparatus to be able to be automatically overwritten by a new set of filter coefficients as soon as the new set of filter coefficients was selected more frequently than the old set. As a result, there also is an adaptation process in respect of changing feedback situations.

The feedback-canceller apparatus can moreover have a comparator, by which the output signal of that filter with the lowest estimated feedback signal strength can be established for the selection. In the process, it is particularly advantageous for the feedback-canceller apparatus to have a measuring unit for measuring the signal energy of the output signal of each filter, and the signal energies to be fed to the comparator for the purposes of the decision. This affords the possibility of making a reliable decision in respect of which filter or which set of filter coefficients is the most effective for the current feedback situation.

In a further embodiment, a plurality of sets of filter coefficients can be stored in the feedback-canceller apparatus and the second filter can be operated on the basis of one of the plurality of sets of filter coefficients. As a result, a suitable set of filter coefficients can be selected for the second filter, for example on the basis of a classification of the hearing situation, or a plurality of second filters parallel to the first filter can be operated at the same time with the various sets of filter coefficients in order to select the best filter or the best set of filter coefficients.

In the method according to the invention for reducing feedback, the set of filter coefficients is preferably stored if the respective feedback situation is constant over at least one predefined amount of time. This avoids storing short-term feedback situations and hence rapid switching back and forth between a plurality of filters.

Furthermore, the set of filter coefficients is advantageously stored if the associated feedback situation occurs with a predefined minimum frequency. As a result, this makes sure that only the respective sets of filter coefficients for truly characteristic feedback situations are stored.

Other features which are considered as characteristic for the invention are set forth in the appended claims.

Although the invention is illustrated and described herein as embodied in a hearing device with feedback-reduction filters operated in parallel, and a method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments explained in more detail below constitute preferred embodiments of the present invention.

Figure 1:
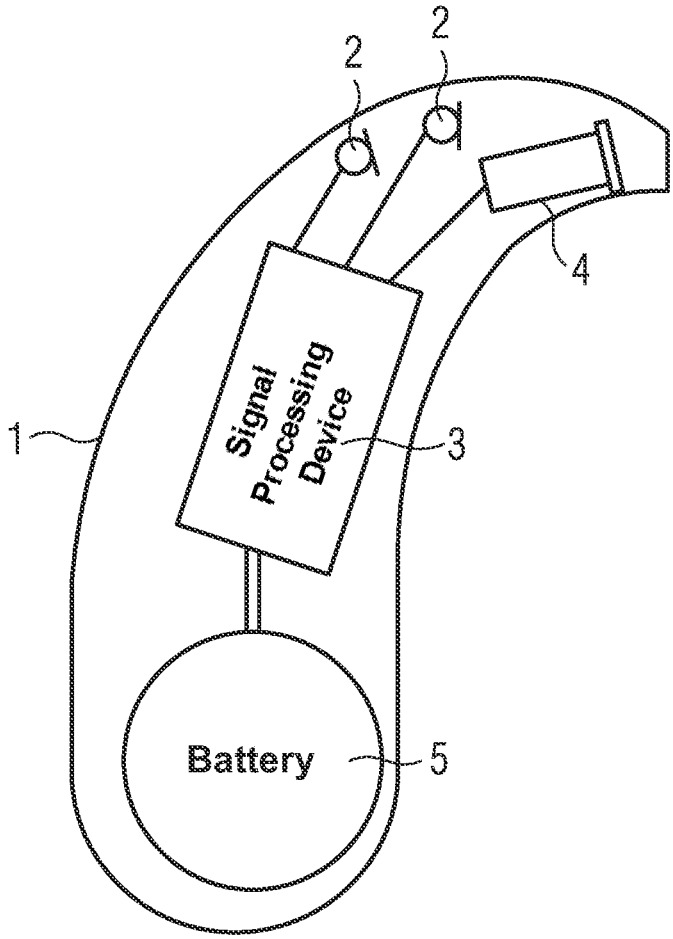
FIG. 1 PRIOR ART
FIG. 1 shows a basic design of a hearing aid according to the prior art.
Figure 2:
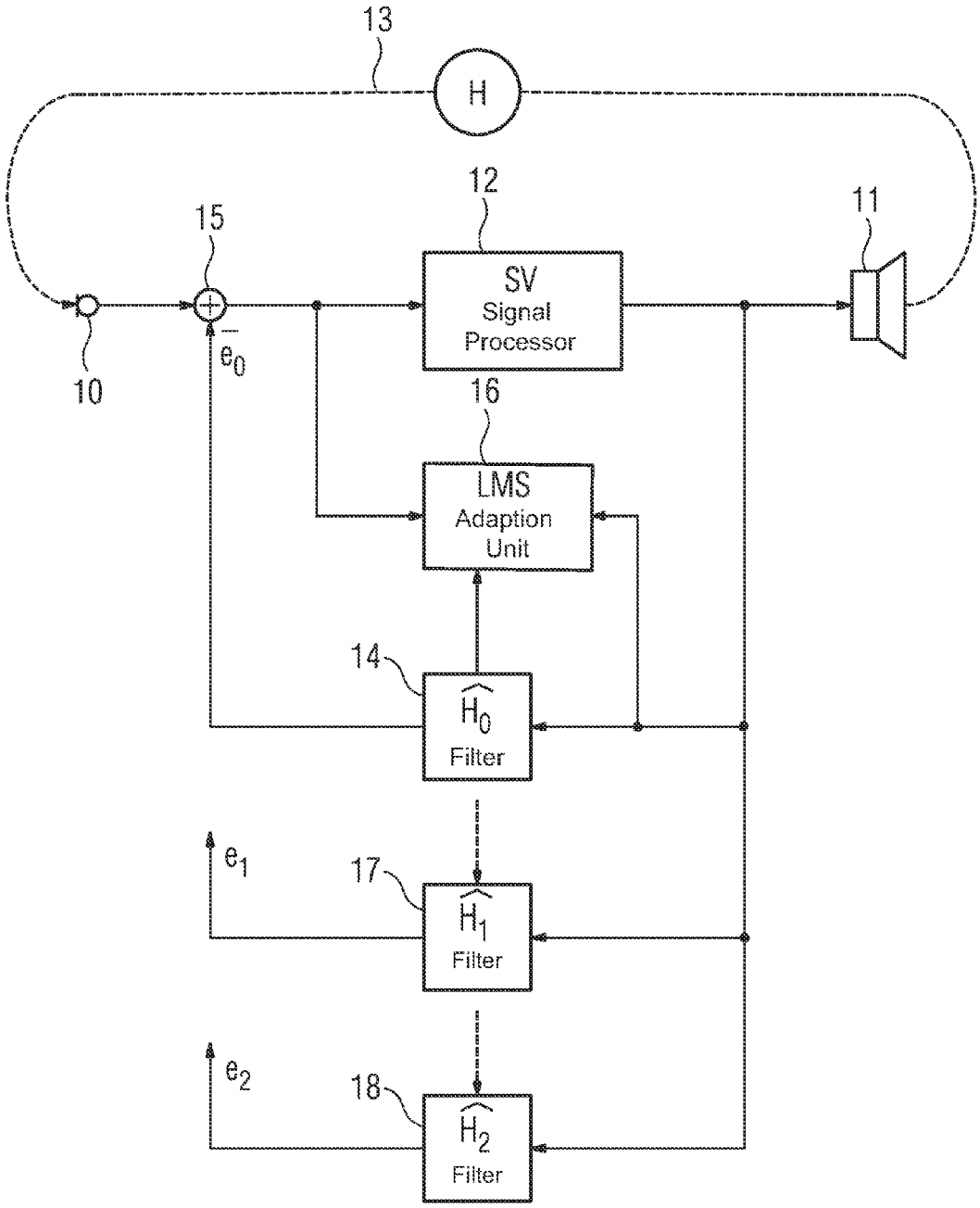
FIG. 2 is a block diagram showing signal processing of a hearing aid according to the invention.

FIG. 2 schematically illustrates a signal-processing system of a hearing aid or a hearing device. The hearing aid has a microphone 10 for supplying an input signal, and a receiver or loudspeaker 11 that converts an output signal into a corresponding output sound. A signal-processing apparatus 12 processes the input signal from the microphone 10 to form the output signal. The output sound of the loudspeaker 11 reaches the microphone 10 of the hearing aid via an acoustic feedback path 13. The feedback path 13 has the transfer function H.

The feedback is at least partly compensated for in a known fashion by an adaptive filter 14. The adaptive filter 14 reproduces or estimates the feedback transfer function H using a transfer function $\hat{H}_0$. In the present context, the adaptive filter 14 constitutes a first filter of the feedback-canceller apparatus. Its input is supplied by the output signal from the signal-processing apparatus 12. The output from the adaptive filter 14 is applied to a subtractor 15, which subtracts the output signal $e_0$ of the adaptive filter 14 from the input signal of the microphone 10. Thus, the output signal $e_0$ from the adaptive filter 14 constitutes an estimate of the signal fed back via the feedback path 13, and hence it constitutes an estimate of the noise or error signal.

The adaptive filter 14 is adapted as a function of the difference signal downstream of the subtractor 15, i.e. as a function of the useful signal from which feedback has been removed, and as a function of the output signal from the signal-processing apparatus 12. To this end, provision is made for an adaptation unit 16, which, for example, calculates the least mean squares error from the two aforementioned signals.

According to the invention, a further filter 17 is now provided parallel to the adaptive filter 14, and a further filter 18 is also provided in parallel. Moreover, provision can be made in the hearing device for further parallel filters. Like the adaptive filter 14, the filters 17 and 18, which carry out the processing in parallel with the adaptive filter 14, each obtain the output signal from the signal-processing apparatus 12 as an input signal. The dashed arrows in FIG. 2 indicate that the filters 17 and 18 can obtain sets of filter coefficients directly or after an appropriate conversion from the adaptive filter 14. The output signals $e_1$ and $e_2$ are provided by the two filters 17 and 18. The output signals from other filters (not illustrated in FIG. 2) are optionally also provided, which other filters are likewise parallel to the filters 14, 17, and 18. Depending on which of the filters 14, 17, and 18 has the best feedback-cancelling properties (the fewest feedback artifacts), the subtractor 15 makes use of the corresponding filter output signal $e_0$, $e_1$ or $e_2$ (feedback-estimate signals).

All filters 14, 17, and 18 are always operated in parallel. That is to say one of these filters is actually used to cancel feedback, while the others only operate as well for comparative purposes and can therefore be denoted as so-called shadow filters.

The goal now is to provide, as quickly as possible, an optimally effective filter for feedback cancelling and, in a best-case scenario, completely avoid feedback whistle. Thus, a plurality of relevant feedback estimation paths is provided by the various filters. Each estimation path has a memory, in which a set of filter coefficients can be stored. The appropriate path is then selected and applied, depending on the respective feedback situation. The remaining paths then are shadow paths or shadow filters.

The system as per FIG. 2 must first of all run through an initialization phase. This means that initially the filter memory of each filter is empty and has to be filled. Filling is brought about as in a so-called log, in which events are continuously recorded. In the present case, filter coefficients corresponding to the occurred feedback situations are recorded in the memories of the filters. The following text presents two possible options according to which the coefficient memories can be filled. The two options can be implemented individually or in conjunction with one another.

According to the first option, a set of relevant feedback paths is measured by an audiologist, preferably in situ, during an adjustment process. By way of example, such relevant feedback paths are generated when telephoning, if the telephone is held in front of the ear, or when putting on a hat, if the arm or the hand is held in front of the ear. The measured feedback paths, i.e. the sets of filter coefficients established for the relevant feedback paths, are stored in an internal memory of the hearing aid, i.e. in the feedback-path log.

According to the second option, the hearing aid operates in a conventional feedback-adaptation mode. If a stable feedback path, i.e. a feedback path that does not change over a relatively long period of time, is found, the associated filter (i.e. the set of filter coefficients) is written into the feedback log. Different methods can be used to establish whether the feedback path is stable. By way of example, a feedback path is stable if no feedback is determined over a certain amount of time. However, a feedback path can also be referred to as stable if the same measured path or the same sets of filter coefficients occur very frequently.

After a certain amount of time, the log or the coefficient memories will have a certain number of entries. Naturally, the number of entries is limited. In this case, entries can be overwritten if other entries or filters appear to be more relevant than previously entered ones. Thus, by way of example, filters (sets of filter coefficients) that are never or hardly ever used can be removed from the log and more frequently used ones can be added. Thus, this is a "dynamic log".

The initialization phase is followed by the operational phase of the hearing device. During this operational phase, the hearing system accesses the log entries. By way of example, there can be n log entries. On the basis of this, at least one and at most n filters with filter coefficients from the log will, as shadow filters, run in parallel with the currently utilized filter. Therefore at least one further filter is operated in parallel in addition to the adaptive filter. Either this shadow filter is also an adaptive filter or the shadow filter is a non-adaptive filter. However, only one of these operational filters contributes to the actual signal path of the hearing device. Therefore only the output signal from a single one of these filters 14, 17, 18 is subtracted from the input signal of the microphone 10.

Figure 3:
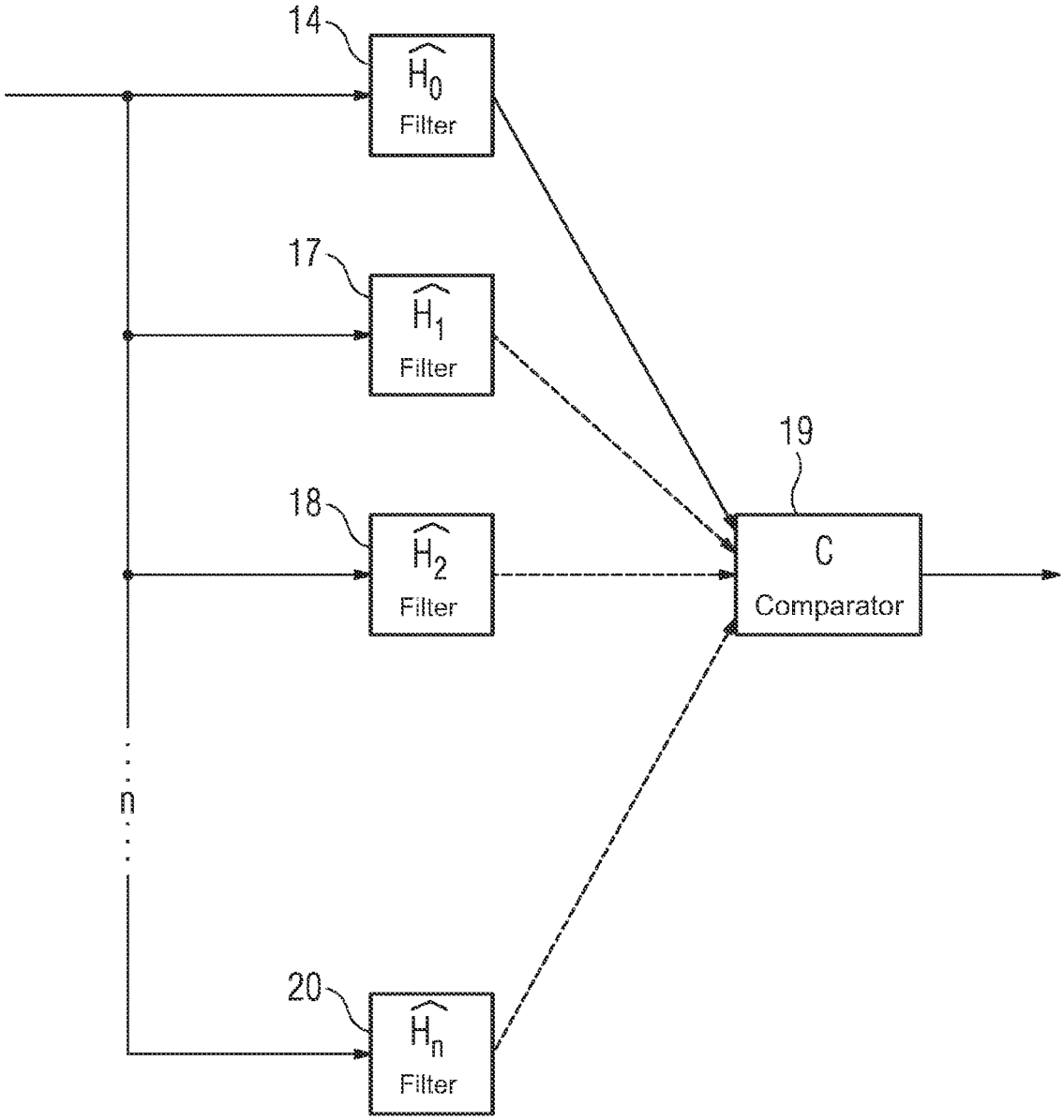
FIG. 3 is a schematic block diagram for selecting a suitable filter.

Thus, a decision has to be made in the hearing device in respect of which filter is utilized in the current feedback situation. To this end, according to the example in FIG. 3, use is made of a comparator 19. The outputs of all filters 14, 17, 18, 20 are connected to the comparator 19, with the filter with the reference sign 20 being an n-th filter of the hearing device. The individual filters 17, 18, and 20 are equipped with the filter coefficients from the log. As an alternative, provision can also be made for only a single, second filter in addition to the adaptive, first filter 14, wherein different sets of filter coefficients, which are stored in the log, can be read into this second filter.

The comparator 19 now checks which signal path (the one with the adaptive filter 14 or one with a shadow filter 17, 18, 20) has the weakest feedback signal. By way of example, this can be brought about by measuring the output energy of the respective filters. Alternatively, or in addition thereto, it is also possible to evaluate the impulse responses of the filters or errors, and/or deviations between the microphone signal and an output signal of one of the filters. If a filter can be established that is significantly better than the current one, this better filter is applied as the signal path of the hearing device.

A further embodiment also allows the filter coefficients of the adaptive filter to be overwritten by those of a currently utilized filter (if the latter is a shadow filter). This is particularly advantageous if the coefficients of a log entry are more effective in respect of feedback cancelling. In this case, the adaptive filter can always be the active filter.

Once the feedback paths or the corresponding sets of filter coefficients have been stored in the log, a further embodiment allows a reduction in the computational complexity of the shadow filters by using more efficient implementations of shadow filters, e.g. infinite impulse response (IIR) filters or the like. The adaptive filter is usually a finite impulse response (FIR) filter, which requires more filter coefficients than a comparable IIR filter.

The following text briefly explains an example on the basis of a hearing aid for closed supply. If the earpiece fits well into the auditory canal, the hearing aid is very robust against feedback. However, if the hearing-aid wearer moves his/her mouth, the auditory canal with the earpiece can develop small openings, and so feedback occurs for a short period of time. In this situation, the feedback-canceller system has previously initiated the adaptation due to the short feedback events. However, the time taken by the feedback events is too short for a good adaptation. The auditory canal with the hearing aid is closed again after the mouth movement, but the filter produces bothersome artifacts as a result of the erroneous adaptation. However, if, according to the invention, the log contains an entry for both situations (the closed auditory canal and the slightly opened auditory canal), there can be substantially faster feedback-cancelling. Rather than initiating a new adaptation, the feedback-canceller system merely needs to switch between the two filters. However, adaptations after the switch also remain an option in order to react to small changes in the feedback path. However, this too is faster than carrying out a completely new adaptation.

Hence, the hearing device according to the invention optionally has a self-learning algorithm, which generates a log with different feedback paths (dynamic log). This does not only help in accelerating the adaptation time, but in the best case also allows complete or partial compensation of the feedback before a whistle can even be perceived.

The invention claimed is:

1. A hearing device, comprising:

a signal-processing apparatus for processing an input signal into an output signal; and a feedback-canceller apparatus for reducing feedback artifacts on a basis of the input signal and the output signal, said feedback-canceller apparatus having an adaptive, first filter, for establishing a set of filter coefficients for a predefined feedback situation, said the feedback-canceller apparatus configured to store the set of filter coefficients, said feedback-canceller apparatus having at least one second filter, being operated directly parallel to said adaptive, first filter on a basis of the stored set of filter coefficients, said adaptive, first filter being continuously adapted to a current feedback situation, and said feedback-canceller apparatus configured such that in the current feedback situation said feedback-canceller apparatus automatically selects either said adaptive, first filter or said second filter, wherein the set of filter coefficients in said feedback-canceller apparatus can automatically be overwritten by a new set of filter coefficients if the new set of filter coefficients was selected more frequently than an old set of filter coefficients.

2. The hearing device according to claim 1, wherein said adaptive, first filter is a finite impulse response filter and said second filter is an infinite impulse response filter.

3. The hearing device according to claim 1, wherein said first and second filters that are part of said feedback-canceller apparatus and can be operated in parallel are finite impulse response filters.

4. The hearing device according to claim 1, wherein said feedback-canceller apparatus has a comparator, by means of which one of said first and second filters being operated in parallel can be selected automatically.

5. The hearing device according to claim 4, wherein said feedback-canceller apparatus has a measuring unit for measuring signal energy of the output signal of each of said first and second filters, and the signal energies are fed to said comparator for purposes of a decision.

6. The hearing device according to claim 1, wherein a plurality of sets of filter coefficients can be stored in said feedback-canceller apparatus and said second filter can be operated on a basis of one of the plurality of sets of filter coefficients.

7. A method for compensating for feedback in a hearing device, which comprises the steps of:

processing an input signal into an output signal;

reducing feedback artifacts on a basis of the input signal and the output signal;

providing an adaptive, first filter, by means of which a set of filter coefficients is established for a predefined feedback situation;

storing the set of filter coefficients in the hearing device;

providing at least one second filter being operated directly parallel to the adaptive, first filter on a basis of a stored set of filter coefficients;

adapting continuously the adaptive, first filter to a current feedback situation;

automatically selecting either the first or the second filter for reducing the feedback in the current feedback situation; and automatically overwriting the set of filter coefficients with a new set of filter coefficients if the new set of filter coefficients was selected more frequently than an old set of filter coefficients.

8. The method according to claim 7, which further comprises storing the set of filter coefficients if the respective feedback situation is constant over at least one predefined amount of time.

9. The method according to claim 7, which further comprises storing the set of filter coefficients if an associated feedback situation occurs with a predefined minimum frequency.

* * * * *